US005894909A

United States Patent [19]

Cornish

[11] Patent Number: 5,894,909

[45] Date of Patent: Apr. 20, 1999

[54] SCAFFOLDING

[75] Inventor: John R. E. Cornish, East Grinstead, United Kingdom

[73] Assignee: SGB Services PLC, United Kingdom

[21] Appl. No.: 08/840,185

[22] Filed: Apr. 11, 1997

[51] Int. Cl.[6] ..... E04G 1/15

[52] U.S. Cl. ..... 182/186.8; 182/186.7; 182/119; 182/222

[58] Field of Search ..... 182/186.7, 186.8, 182/119, 222, 179.1

[56] References Cited

FOREIGN PATENT DOCUMENTS 0 491 634 A1 6/1992 European Pat. Off. .
1 463 867 2/1977 United Kingdom .
2076878 12/1981 United Kingdom ..... 182/222

*Primary Examiner*—Alvin Chin-Shue
*Attorney, Agent, or Firm*—Arnold, White & Durkee

[57] ABSTRACT

A scaffolding assembly having at least one pair of substantially parallel spaced-apart scaffolding components, each of which extends between a pair of substantially vertical spaced-apart uprights and supports a respective end of a deck plate extending therebetween. Each scaffolding component is adapted to receive a respective end of said deck plate and prevent accidental disengagement of said deck plate due to wind or accidental contact. Each end of the scaffolding component is provided with oppositely directed tongues extending laterally therefrom, said tongues being adapted to engage securing means mounted on each of said uprights.

11 Claims, 4 Drawing Sheets

SCAFFOLDING

BACKGROUND OF THE INVENTION

The present invention relates to a scaffolding system and, more particularly, to a scaffolding assembly including horizontal scaffolding components or ledgers and transoms which extend between a pair of substantially vertical scaffolding uprights or standards and to support one end of a scaffolding platform or deck plate.

Once a scaffolding structure has been assembled, it is necessary to provide a platform of some description upon which workmen may stand and walk. Typically, removable scaffolding deck plates are used for this purpose and are supported at either end by a horizontal scaffolding component or transom forming part of the scaffolding structure.

It has been proposed previously, to provide such scaffolding deck plates with downwardly depending hooks at either end thereof, the hooks being adapted to engage an upper edge of a U-shaped channel section of a respective cross-member. Whilst this system is clearly more secure than simply laying wooden planks or deck plates on top of cross-members, in that it prevents the planks or deck plates sliding off the cross-members, significant problems have been experienced regarding vertical movement of the deck plates and hence disengagement of the hooks thereof with the U-sectioned cross-members. For instance, when a scaffolding system is used in an exposed area, wind speed can be significant and hence substantial vertical forces may be applied to the deck plates tending to lift them and disengage their hooks with the cross-members. This is a particular problem when scaffolding is used against the walls of buildings in areas where high wind speeds occur, since substantial wind deflection occurs resulting in strong eddies and vertical wind components.

It will thus be appreciated that it is advantageous to provide a scaffolding assembly in which some form of locking arrangement is provided to prevent the ends of deck plates becoming disengaged with their supporting cross-members.

Prior proposed methods of securing the ends of deck plates have involved complicated mechanisms which prevent quick and easy assembly or disassembly of a scaffolding system. Other prior proposed arrangements involve the use of a separate cross-member element disposed substantially vertically above the U-sectioned cross-member and adapted to prevent vertically upward movement of the ends of said deck plate. However, it has been found disadvantageous to require the use of two horizontal cross-members in such scaffolding assemblies as it makes their assembly and disassembly more complicated and hence labor intensive. It is advantageous to provide scaffolding cross-members which may be simply and easily installed and secured to a scaffolding assembly.

SUMMARY OF THE INVENTION

Accordingly, it is an object of the present invention to provide an improved scaffolding assembly in which substantially horizontal scaffolding components are effectively secured between substantially vertical scaffolding uprights to securely engage the end of a substantially horizontal deck plate.

According to one aspect of this invention there is provided a scaffolding assembly comprising at least one pair of substantially parallel spaced apart scaffolding components, each of said scaffolding components extending between a pair of substantially vertical spaced apart uprights and supporting a respective end, having outwardly and downwardly extending hooks, of at least one deck plate extending therebetween, each scaffolding component comprising a pair of vertically spaced-apart substantially horizontal elongate members, the lower elongate member being provided with recesses in an upper part of a side wall thereof, each recess being adapted to receive a respective one of said hooks, at least part of the tipper elongate member having a width less than that of the lower elongate member and being provided with lateral projections, at least part of each projection being located substantially vertically above a corresponding recess to limit the vertical movement of hook received therein whilst permitting horizontal movement of the hook therebelow, each end of the scaffolding component being provided with oppositely directed tongues extending laterally therefrom, said tongues being adapted to engage securing means located on each of said uprights, each of said securing means comprising a pair of opposed retaining elements adapted to receive said tongues, one of said retaining elements being fixed to the upright and the other of said retaining elements being movable along the upright with respect to said fixed retaining clement, such that after separation of said retaining elements, a said tongue can be engaged with the fixed retaining element and upon subsequent movement of the movable retaining element the oppositely directed tongue is engaged by the movable retaining element, thereby securing the end of a respective scaffolding component to the respective upright.

Preferably said elongate member is in the form of an open-topped channel having a pair of upper edges, said recesses being formed in said upper edges.

Advantageously said elongated member is partially received within said channel.

Conveniently said channel has a substantially U-shaped transverse cross-section.

Preferably each scaffolding component has an end plate secured to each end thereof, each said end plate being formed with said oppositely directed tongues.

Advantageously at least one of said end plates is configured to from a sector of a cylinder.

Conveniently said retaining elements comprise a pair of collars which define opposed annular channels around each upright for the reception of said tongues.

Preferably each fixed collar is welded to a respective upright and defines a channel around said upright which is open at its upper end, and the movable collar is slidably and rotatably mounted on a respective upright above the fixed collar and defines a channel around the upright which is open at its lower end.

Advantageously each of said uprights is provided with engaging means for engaging said movable retaining elements to clamp it against movement away from said fixed retaining element after said tongues have been engaged by the movable element.

Conveniently said engaging means comprises a lug secured to the upright above the fixed collar, and the movable collar has a protrusion in which there is provided a vertical slot through which the lug may pass, the arrangement being such that when the lug is in vertical alignment with said slot the movable collar can be moved freely up and down the upright past the lug, but when the movable collar is moved below the lug and rotated, it is prevented from moving upwardly.

Preferably the upper surface of the movable collar is inclined upwardly from said protrusion to form a wedge-shaped surface engageable with said lug when the movable collar is below the lug, the arrangement being such that upon rotation of the movable collar below the lug, the inclined surface engages and wedges beneath the lug, the movable collar thus becoming clamped against movement along the upright away from the fixed collar.

BRIEF DESCRIPTION OF THE DRAWINGS

In order that the invention may be readily understood, and so that further features thereof may be appreciated, the invention will now be described by way of example, with reference to the accompanying drawings in which.

DETAILED DESCRIPTION OF THE INVENTION

Figure 1:
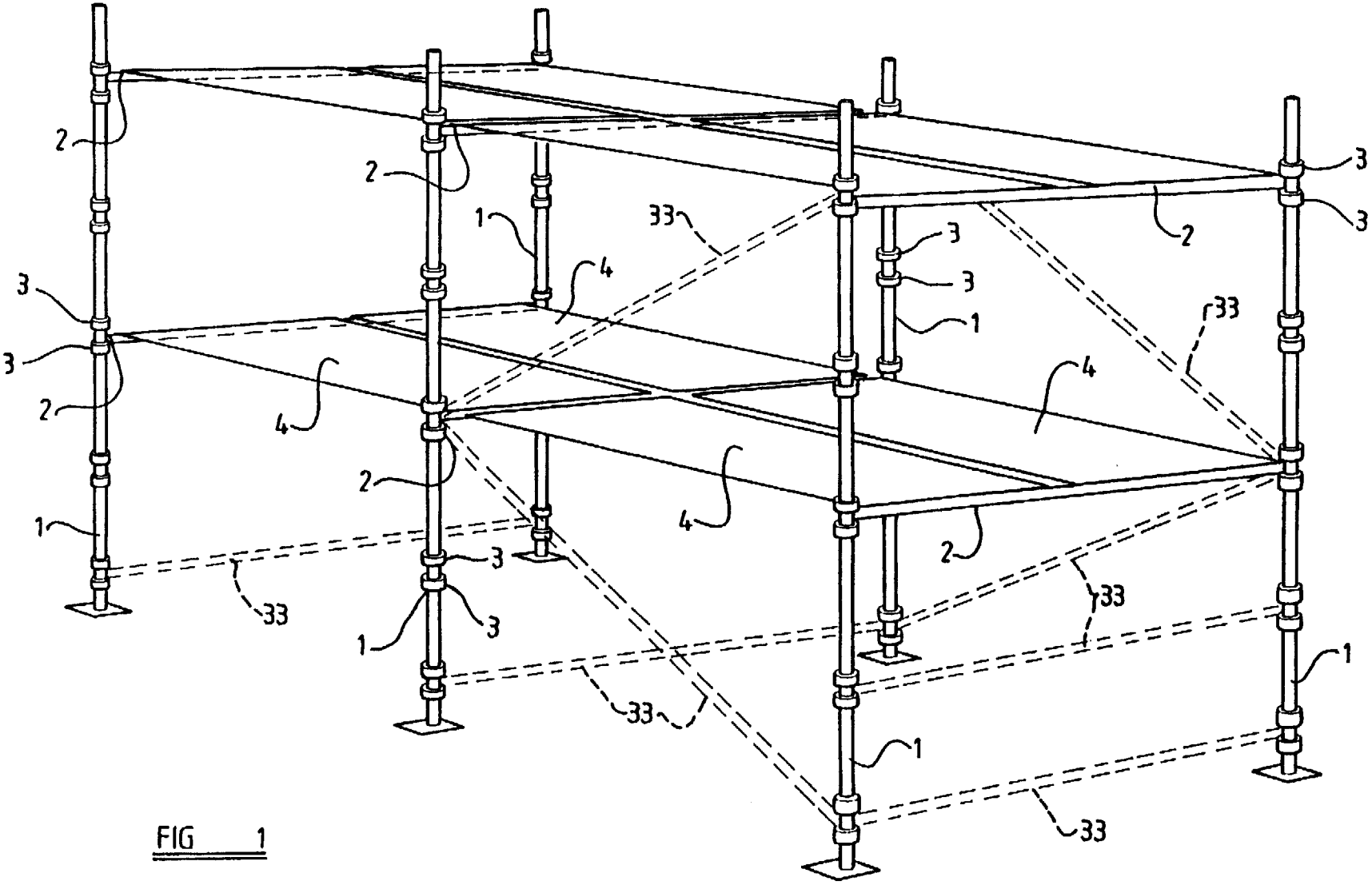
FIG. 1 is a perspective view of a scaffolding assembly in accordance with the present invention.

Referring initially to FIG. 1, there is provided a scaffolding assembly comprising a plurality of substantially vertical uprights 1 arranged in pairs, each pair of uprights 1 having a substantially horizontal scaffolding component 2 extending therebetween. Each upright 1 has a number of securing means 3 located at regular positions along the length of upright 1.

As will also be seen from FIG. 1, there is provided a number of substantially horizontal deck plates 4, each deck plate extending between a pair of spaced-apart horizontal scaffolding components 2. At the ends of each deck plate 4, there is provided at least a pair of downwardly depending hooks, known per se and illustrated schematically at 5 in FIG. 2.

Figure 2:
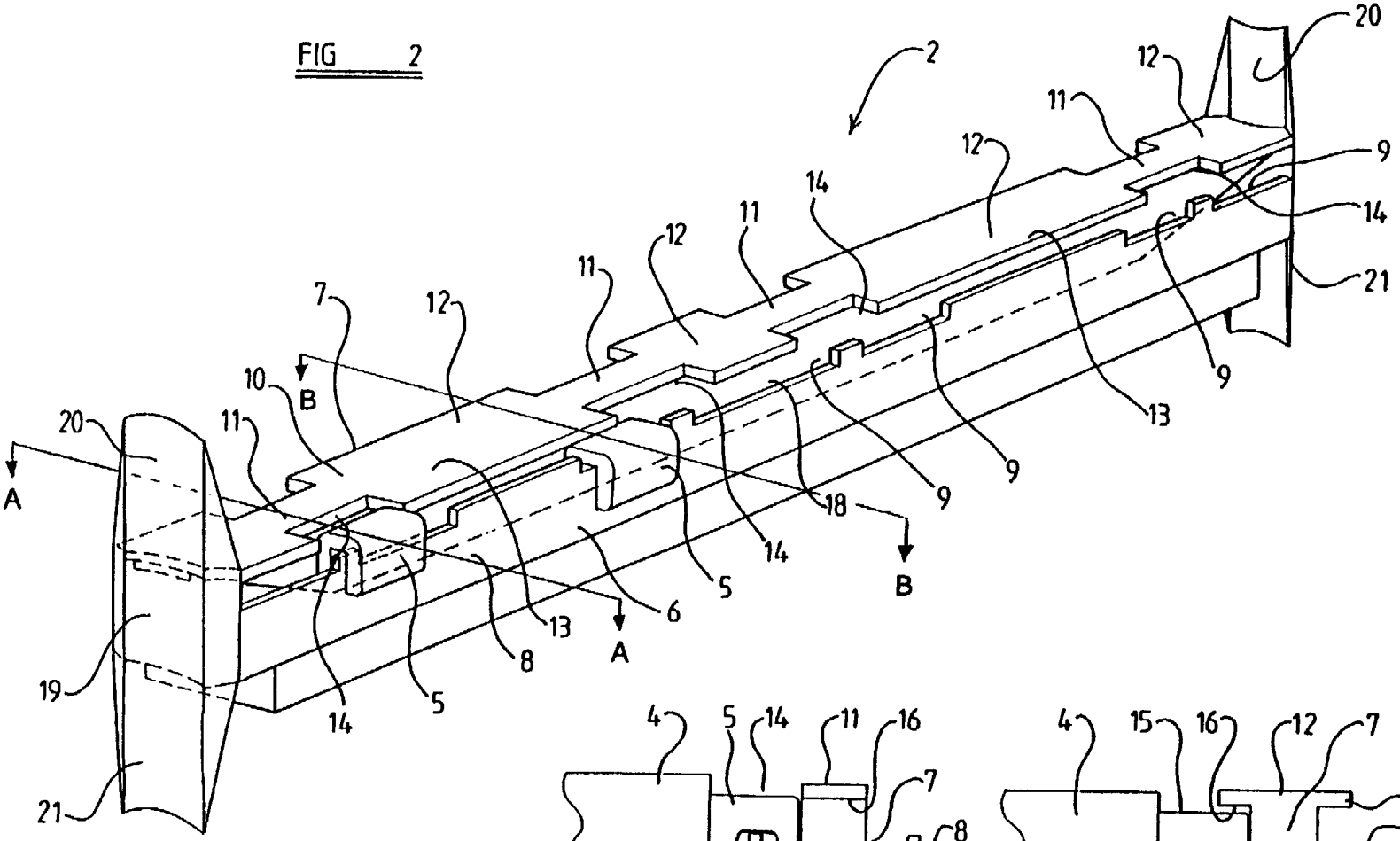
FIG. 2 is a perspective view of a scaffolding component forming part of the assembly of FIG. 1.

FIG. 2 illustrates, in more detail, a single horizontal scaffolding component 2. Each scaffolding component 2 comprises a lower elongate member 6 and an upper elongate member 7, said lower and upper members being vertically spaced-apart.

Figure 3:
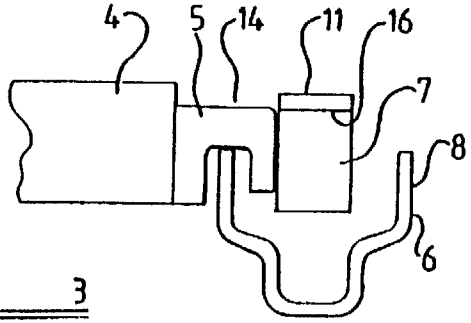
FIG. 3 is a sectional view taken through line A—A of FIG. 2, schematically illustrating a deck plate with hooks in association with the scaffolding component illustrated in FIG. 2 during an initial stage of assembly.
Figure 4:
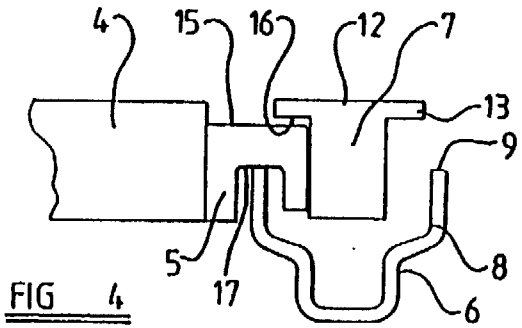
FIG. 4 is a sectional view corresponding to FIG. 3, taken through line B—B of FIG. 2, illustrating the deck plate and scaffolding component during a subsequent stage of assembly.
Figure 5:
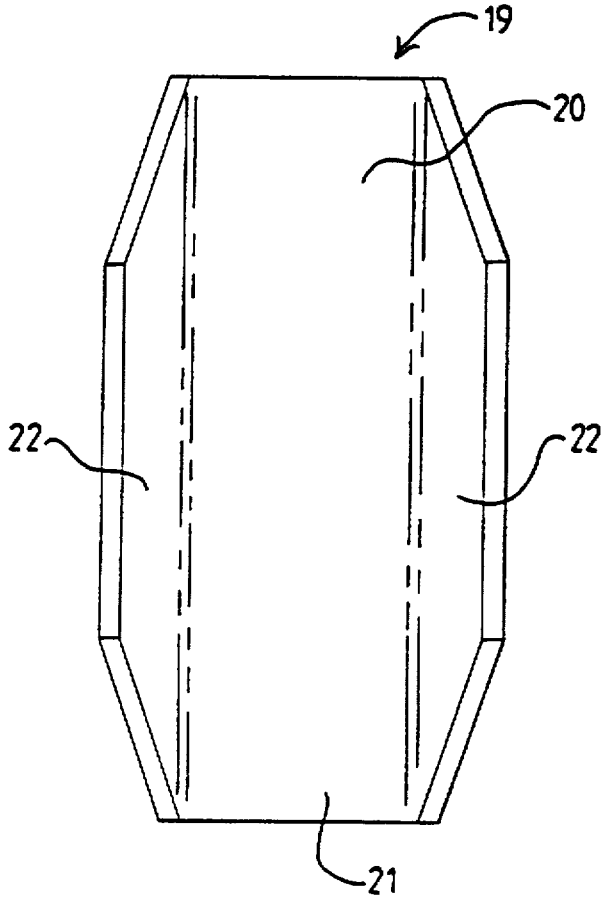
FIG. 5 is a front elevation of part of the scaffolding component part illustrated in FIG. 2.
Figure 6:
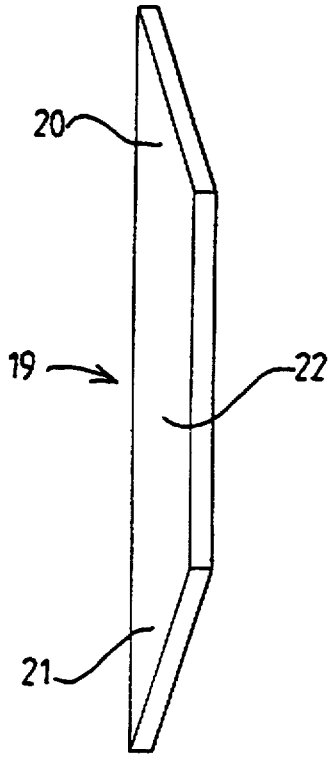
FIG. 6 is a side elevation of the scaffolding component part illustrated in FIG. 5.

As can be seen more clearly from FIGS. 3 and 4, the lower elongate member 6 comprises a channel of substantially U-shaped cross-section, whilst the upper elongate member 7 is substantially rectangular in section and may be of solid or tubular form.

The upper edge of each side wall 8 of lower elongate member 6 terminates with a substantially vertical portion. Along the length of lower elongate member 6, there is provided a number of recesses or cut-outs 9 in the upper edge of each side wall 8. Each recess 9 is adapted to receive a downwardly depending hook 5 as illustrated in FIG. 4.

The upper elongate member 7 is provided with a substantially horizontal top plate 10 having portions 11 of a width substantially less than the width of the upper edges of lower elongate member 6, and portions 12 having a width substantially equal to that of the lower elongate member 6. The result of this is that the upper elongate member 7 is effectively provided with a number of lateral projections 13 extending outwardly from the rectangular main body thereof. Between adjacent lateral projections 13, in the area of portions 11, there results a number of spaces 14. Each space 14 is sized to receive therethrough a respective hook 5.

As can be seen from FIG. 2, at least part of each projection is located substantially vertically above a respective recess 9.

In order to attach an end of a deck plate 4 to a respective scaffolding component 2, firstly each hook 5 thereof is vertically aligned with a respective space 14 formed between adjacent projections 13 of the upper elongate member 7. The deck plate 4 may then be lowered such that each hook 5 passes between adjacent projections 13 and assumes a position vertically below the respective space 14 as illustrated in FIG. 3 in which the upper surface 15 of the hook 5 is below the lowermost surface 16 of top plate 11. The deck plate 4 may then be slid to one side to a position in which each hook 5 is vertically below part of a projection 13, as illustrated in FIG. 4. Note should be made, that for the ease of illustration, the two positions of hooks 5 illustrated in FIG. 2 are not intended to represent initial and subsequent positions of the same hook 5 of a deck plate 4, but rather illustrate a first position of one hook 5 and a subsequent position of a second hook 5.

As illustrated in FIGS. 2 and 4, after effecting the sideways movement, each hook 5 is allowed to move downwardly, into a respective recess 9, such that the under surface 17 thereof rests upon the lower edge of the respective recess 9. Each recess 9, is dimensioned to receive a hook 5 therein and to limit the horizontal movement of the hook 5. However, as can be seen from FIG. 2, the centermost recess 9, indicated at 18, is of an increased width such that it may receive a pair of hooks 5 side by side. In this way, a pair of deck plates 4 may be supported side by side with the minimum of space therebetween, each deck plate having a hook 5 disposed at the corner thereof.

The combination of suitably dimensioned recesses 9 and projections 13 extending over a hook 5 located within a respective recess 9, means that in order to disengage a hook 5 from the scaffolding component 2, it is necessary to effect two, separate movements. Firstly, the hook 5, and hence the deck plate 4, must be moved vertically upwardly such that the hook 5 is removed from the recess 9. However, this vertical movement is limited by the presence of projections 13 and so each hook 5, and hence the deck plate 4, must then be slid horizontally with respect to the scaffolding component 2 until each hook 5 is located directly below a respective space 14 between adjacent projections 13. The hook 5, and hence the deck plate 4, may then be moved vertically upwardly and released from the scaffolding component 2. This two-stage movement prevents the deck plate becoming dislodged by the wind or accidental contact.

Figure 7:
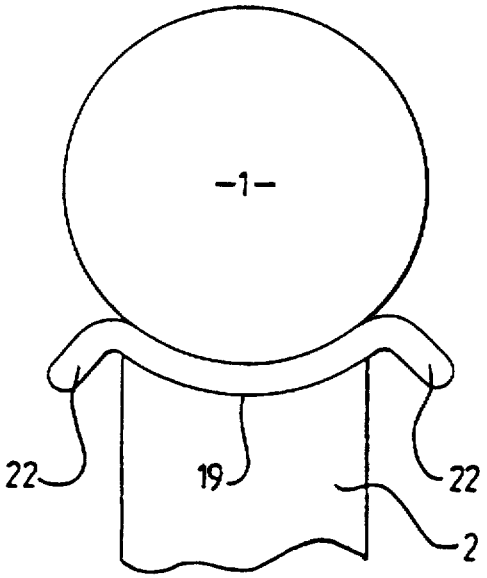
FIG. 7 is a plan view illustrating a scaffolding component part as illustrated in FIGS. 5 and 6, arranged adjacent a scaffolding upright.

At each end of the scaffolding component 2, there is provided a vertical end plate 19 to which the end of both the upper member 7 and the lower member 6 are secured, preferably by welding. Each end plate 19 tapers inwardly at its upper and lower ends into laterally upwardly and downwardly depending tongues 20 and 21 respectively. The tongues 20, 21 project above and below the combination of the lower and upper members 6, 7. As can be seen from FIG. 7, illustrating an end plate 19 in plan form, each end plate 19 forms a sector of a cylinder and has a pair of radially outwardly extending flanges 22. Thus, it is possible to arrange a scaffolding component 2 such that the end plate 19 thereof abuts and fits closely around a section of the outer surface of an upright 1.

Figure 8:
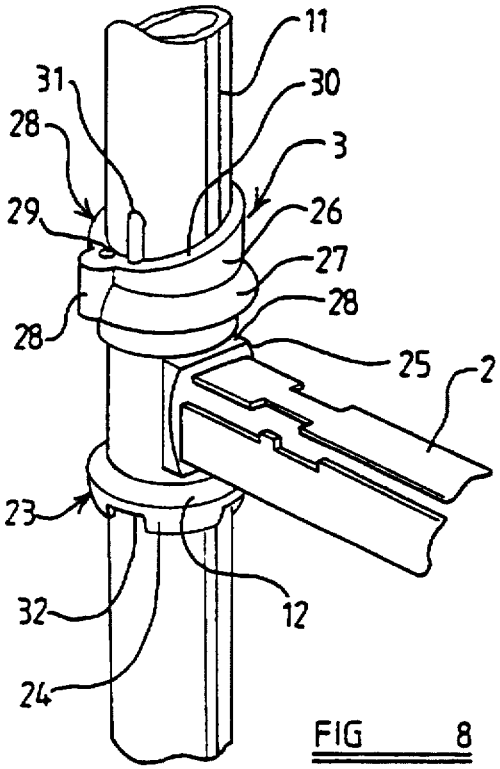
FIG. 8 is a perspective view of a connection between a scaffolding component and a vertical scaffolding upright.
Figure 9:
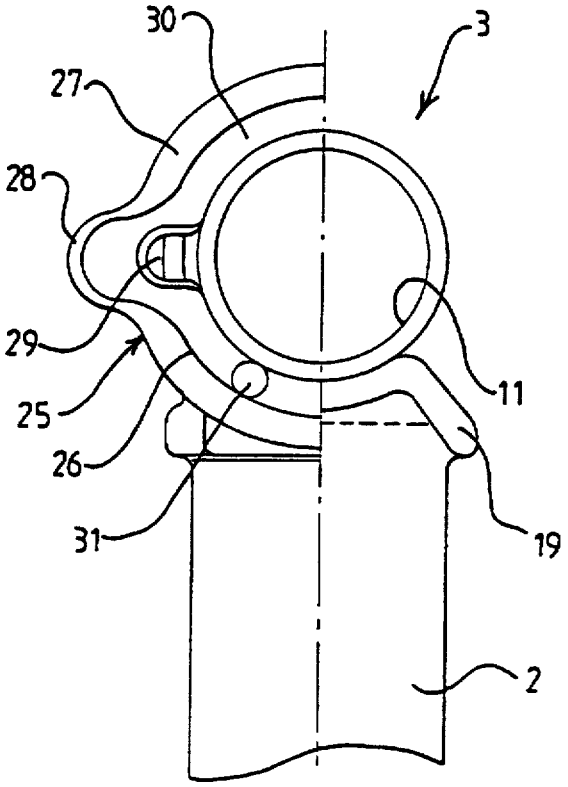
FIG. 9 is a part-plan, part-sectional view of the connection illustrated in FIG. 8.
Figure 11:
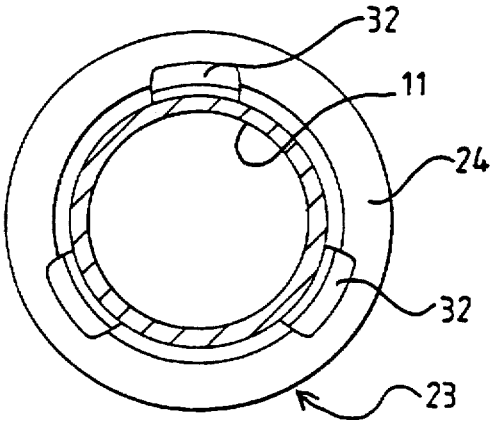
FIG. 11 is a plan view from below of the lower part of the connection illustrated in FIGS. 8, 9 and 10.
Figure 10:
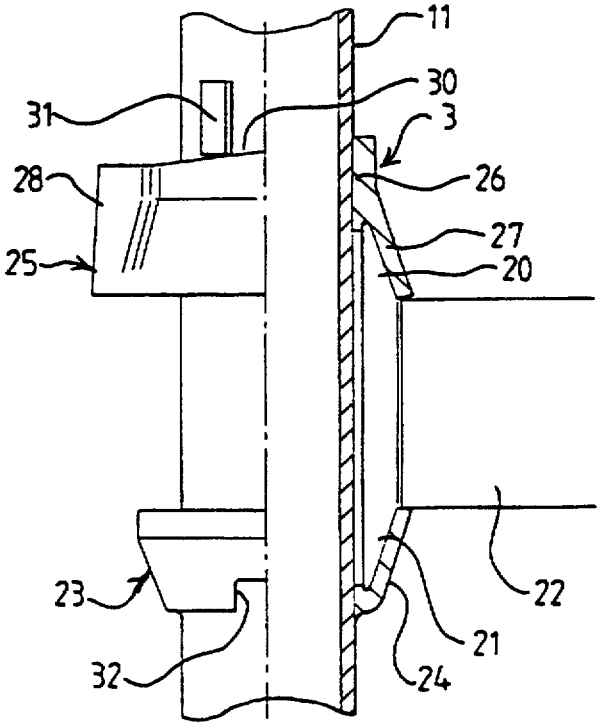
FIG. 10 is a part-side elevation, part-sectional view of the connection illustrated in FIGS. 8 and 9.

Turning now to FIG. 8 of the accompanying drawings, there is illustrated in more detail a connection between a scaffolding component 2 and a securing means 3 of an upright 2.

The securing means 3 comprises, at its lower end, a retaining element in the form of a collar 23 of cup-like form which is welded to an upright 1 so as to define an annular channel around the upright 1, said channel being open at its upper end. The wall of the collar 23 is inclined upwardly and outwardly from the upright 1.

The securing means 3 also comprises, at its upper end, a retaining element in the form of a clamping collar 25 of inverted cup-like form which is slidably mounted on the upright 1 and also defines a channel around the upright 1, the channel in this case, however, being open at its lower end. The side wall of clamping collar 25 has a cylindrical upper part 26 which fits closely around the upright 1 and a downwardly and outwardly inclined lower part 27. At one side, the clamping collar 25 has a radially outwardly directed protrusion 28 in which there is formed, adjacent the upright 1, a vertical slot 29. The top face 30 of the clamping collar 25 may be inclined upwardly from either side of the protrusion 28, as shown, or may be inclined upwardly continuously for a full 360° from one side of the protrusion 28, thus forming a wedge-shaped surface.

A lug 31 is secured to the outer surface of upright 1. Alternatively, it is also possible to form lug 31 integrally with upright 1 during the manufacture of upright 1. Lug 31 is sized so that it may pass through the slot 29 in the protrusion 28 on the clamping collar 25 is rotated to a position in which the lug 31 is vertically in line with slot 29, then the clamping collar 25 may be moved up and down the upright 1 past the lug 31.

In order to effect the assembly of a connection between scaffolding component 2 and a securing means 3 of an upright 1, the clamping collar 25 is initially rotated to a position in which the slot 29 is in vertical alignment with the lug 31 so that the clamping collar 25 may be moved upwardly, past the lug 31. The clamping collar 25 is then rotated to a position in which the slot 29 is out of alignment with the lug 31, such that the clamping collar 25 may be rested on top of the lug 31. Lower tongue 21 of the endplate 19 of the scaffolding member 2 may now be inserted into the lower channel defined by the fixed collar 24 on the upright 1. The lower tongue 21, due to its tapered form, fits snugly into the annular channel defined by the fixed collar 24. As previously mentioned, the end plate 19 defines a sector of a cylinder, such that when the tongue 21 has been inserted into the fixed collar 24, the end plate 19 abuts and fits closely around the upright 1.

The clamping collar 25 is now rotated back until the slot 29 formed in the protrusion 28 is in vertical alignment with the lug 31, and is then dropped past the lug 31 and rotated again so that the lug 31 now engages the inclined top surface 30 of the clamping collar 25. By exerting a tangential force on the protrusion 28, for instance with the aid of a hammer, the clamping collar 25 can be wedged tightly beneath the lug 31. The upper tongue 20 on the end plate 19 of scaffolding members 2, due to its generally similar form to the lower tongue 21, wedges tightly in the lower part 27 of the clamping collar 24.

In order to dismantle a connection, the reverse procedure is followed.

The fixed collar 24 is preferably formed with one or more apertures 32 along its lower edge providing drainage means to enable water and dirt to drain from the lower annular channel.

Referring again to FIG. 1, there may also be provided a number of horizontal or diagonal reinforcing braces 33 extending between respective uprights 1 in order to strengthen the scaffolding assembly. Each brace 33 may also be provided with end plates 19 such that it may be connected to securing means 3 on uprights 1. In the case of a diagonal brace 33, the end plates 19 thereof must be secured thereto at an angle to the main body of the brace.

While the present invention has been described with reference to one or more particular embodiments, those skilled in the art will recognize that many changes can be made thereto without departing from the spirit and scope of the present invention. Each of these embodiments and obvious variations thereof is contemplated as falling within the spirit and scope of the claimed invention which is set forth in the following claims.

What is claimed is:

1. A scaffolding assembly comprising:

at least one pair of substantially parallel spaced apart scaffolding components; and a pair of substantially vertical spaced apart uprights, each of said scaffolding components extending between said pair of substantially vertical spaced apart uprights and supporting a respective end, having outwardly and downwardly extending hooks, of at least one deck plate extending therebetween;

each scaffolding component comprising a an upper substantially horizontal elongate member, a lower substantially horizontal elongate member fixedly coupled in vertically spaced-apart relation to said upper elongate member, each said scaffolding component has an end plate secured to each end thereof, each end plate being secured to both a respective upper and lower substantially horizontal elongated members in fixing said upper and lower substantially horizontal elongated members in the vertically spaced-apart relationship; each said end plate being formed with oppositely directed tongues, a first of said oppositely directed tongue extending laterally from a first end of said upper and lower elongate members, and a second of said oppositely directed tongue extending laterally from a second end of said upper and lower elongate members, the lower elongate member including recesses in an upper part of a side wall thereof, each recess being adapted to receive a respective one of said hooks, at least part of the upper elongate member having a width less than that of the lower elongate member and being provided with lateral projections, at least part of each projection being located substantially vertically above a corresponding recess to limit the vertical movement of hook received therein while permitting horizontal movement of the hook therebelow, said first and second of said oppositely directed tongues being adapted to engage securing means located on each of said uprights;

each of said securing means comprising a pair of opposed retaining elements adapted to receive said tongues, one of said retaining elements being fixed to the upright and the other of said retaining elements being movable along the upright with respect to said fixed retaining element, such that after separation of said retaining elements, a said oppositely directed tongues can be engaged with the fixed retaining element and upon subsequent movement of the movable retaining element the oppositely directed tongues are engaged by the movable retaining element, thereby securing the end of a respective scaffolding component to the respective upright.

2. The scaffolding assembly according to claim 1, wherein said lower elongate member is in the form of an open-topped channel having a pair of upper edges, said recesses being formed in said upper edges.

3. The scaffolding assembly according to claim 2, wherein said upper elongate member is partially received within said channel.

4. The scaffolding assembly according to claim 2, wherein said channel has a substantially U-shaped transverse cross-section.

5. The scaffolding assembly according to claim 1, wherein at least one of said end plates is configured to form a sector of a cylinder.

6. The scaffolding assembly according to claim 1, wherein said retaining elements comprise a pair of collars which define opposed annular channels around each upright for the reception of said oppositely directed tongues.

7. The scaffolding assembly according to claim 6, wherein each fixed collar is welded to a respective upright and defines a channel around said upright which is open at its upper end, and the movable collar is slidably and rotatably mounted on a respective upright above the fixed collar and defines a channel around the upright which is open at its lower end.

8. The scaffolding assembly according to claim 1, wherein each of said uprights is provided with engaging means for engaging said movable retaining elements to clamp it against movement away from said fixed retaining element after said oppositely directed tongues have been engaged by the movable element.

9. A scaffolding assembly according to claim 8, wherein said engaging means comprises a lug secured to the upright above the fixed collar, and the movable collar has a protrusion in which there is provided a vertical slot through which the lug may pass, the arrangement being such that when the lug is in vertical alignment with said slot the movable collar can be moved freely up and down the upright past the lug, but when the movable collar is moved below the lug and rotated, it is prevented from moving upwardly.

10. A scaffolding assembly according to claim 9, wherein the upper surface of the movable collar is inclined upwardly from said protrusion to form a wedge-shaped surface engageable with said lug when the movable collar is below the lug, the arrangement being such that upon rotation of the movable collar below the lug, the inclined surface engages and wedges beneath the lug, the movable collar thus becoming clamped against movement along the upright away from the fixed collar.

11. The scaffolding assembly according to claim 3, wherein said channel has a substantially U-shaped transverse cross-section.

* * * * *

UNITED STATES PATENT AND TRADEMARK OFFICE

CERTIFICATE OF CORRECTION

| | | |
|---|---|---|
| PATENT NO. | : | 5,894,909 |
| DATED | : | April 20, 1999 |
| INVENTOR(S) | : | John R. E. Cornish |

It is certified that error appears in the above-identified patent and that said Letters Patent is hereby corrected as shown below:

In column 2, line 9, please delete "tipper" and replace with --upper-- therefore.

Signed and Sealed this

Ninth Day of November, 1999

*Attest:*

Q. TODD DICKINSON

*Attesting Officer*

*Acting Commissioner of Patents and Trademarks*